United States Patent [19]

Kishimoto et al.

[11] Patent Number: 4,621,047

[45] Date of Patent: Nov. 4, 1986

[54] METHOD FOR PROCESSING COLOR PHOTOGRAPHIC LIGHT-SENSITIVE MATERIAL

[75] Inventors: Shinzo Kishimoto; Akira Abe; Shigeru Ohno, all of Kanagawa, Japan

[73] Assignee: Fuji Photo Film Co., Ltd., Kanagawa, Japan

[21] Appl. No.: 736,625

[22] Filed: May 21, 1985

[51] Int. Cl.[4] ..... G03C 7/32; G03C 5/44

[52] U.S. Cl. ..... 430/393; 430/384; 430/385; 430/430; 430/552; 430/553

[58] Field of Search ..... 430/393, 384, 385, 430, 430/552, 553

[56] References Cited

U.S. PATENT DOCUMENTS

| | | | |
|---|---|---|---|
| 4,268,618 | 5/1981 | Hashimura | 430/430 |
| 4,293,639 | 10/1981 | Itoh et al. | 430/430 |
| 4,477,558 | 10/1984 | Ogawa et al. | 430/393 |
| 4,508,816 | 4/1985 | Yamamuro et al. | 430/393 |

*Primary Examiner*—Mary F. Downey

*Attorney, Agent, or Firm*—Sughrue, Mion, Zinn, Macpeak & Seas

[57] ABSTRACT

A method for processing a color photographic light-sensitive material comprising subjecting an imagewise exposed silver halide color photographic light-sensitive material to color development processing, then to processing with a bleaching solution and thereafter to separately, fixing processing wherein the silver halide color photographic light-sensitive material contains a cyan dye forming coupler represented by the general formula (I-a) or (I-b) described below, the bleaching solution contains a compound represented by the general formula (II-a) or (II-b) described below and the processing time for the bleaching solution is substantially not more than 2 minutes and 30 seconds, (I-a)

(I-b)

wherein $R^1$, $R^2$ and $R^4$ each represents a substituted or unsubstituted aliphatic group, a substituted or unsubstituted aryl group or a substituted or unsubstituted heterocyclic group; $R^3$ and $R^6$ each represents a hydrogen atom, a halogen atom, a substituted or unsubstituted aliphatic group, a substituted or unsubstituted aryl group or an acylamino group, or $R^3$ represents a non-metallic atomic group necessary to form a nitrogen-containing 5-membered or 6-membered ring together with $R^2$, $R^5$ presents a substituted or unsubstituted alkyl group; $Z^1$ and $Z^2$ each represents a hydrogen atom or a group capable of being released upon the oxidative coupling reaction with a developing agent; and n represents 0 or 1, (II-a)

(II-b)

wherein $R^7$, $R^8$, $R^9$ and $R^{10}$, which may be the same or different, each represents a hydrogen atom, a substituted or unsubstituted lower alkyl group or an acyl group, or $R^7$, $R^8$, $R^9$ and $R^{10}$ may connect to each other to form a ring; and m and each represents an integer of 1 to 3.

24 Claims, No Drawings

METHOD FOR PROCESSING COLOR PHOTOGRAPHIC LIGHT-SENSITIVE MATERIAL

FIELD OF THE INVENTION

The present invention relates to a method for processing a color photographic light-sensitive material and, more particularly, to an improved method for processing a color photographic light-sensitive material which is not accompanied by degradation of the photographic properties in spite of a shortened period of bleach processing, or a use of an exhausted bleaching solution.

BACKGROUND OF THE INVENTION

The fundamental steps of processing silver halide color photographic light-sensitive materials generally include a color developing step and a deslivering step. That is, an imagewise exposed silver halide exposed silver halide color photographic light-sensitive material is introduced into a color developing step, wherein silver halide is reduced with a color developing agent to produce silver and the oxidized color developing agent in turn reacts with a color former to give a dye image. Subsequently, the color photographic material is introduced into a delivering step, wherein silver having been produced in the preceding step is oxidized with an oxidizing agent (usually called a bleaching agent), and dissolved away with a silver ion complexing agent usually called a fixing agent. Therefore, only a dye image is formed in the thus processed photographic material. In addition to the above-described two fundamental steps of color development and desilvering, actual development processing involves auxiliary steps for maintaining the photographic and physical quality of the resulting image or for improving the preservability of the image. For example, there is a hardening bath for preventing the light-sensitive layer from being excessively softened during photographic processing, a stopping bath for effectively stopping the developing reaction, an image stabilizing bath for stabilizing the image, and a layer removing bath for removing the backing layer on the support.

In general, ferricyanides are employed in a bleaching solution as bleaching agents. However, the bleaching solution containing ferricyanides are disadvantageous in that an exhausted bleaching solution must be exchanged for a fresh bleaching solution and ferricyanide ions, which are discharged by overflow or carrying into washing water subsequent to the bleaching processing during processing and ferrocyanide ions which are reduction forms of ferricyanides, can form cyanide compounds by photogchemical oxidation. These cyanide compounds are strongly poisonous and cause severe pollution.

On the other hand, potassium bichromate, ferric salts, persulfates, quinones, copper salts, etc., have been heretofore employed as bleaching agents other than the ferricyanides. However, these are also disadvantageous in view of their weak oxidizing power and difficulty in handling.

In recent years, bleaching methods employing ferric ion complex salts (e.g., aminopolycarboxylic acid-ferric ion complex salts, particularly iron (III) ethylenediaminetetraacetate complex salts) as major components have been generally utilized in view of requirements for rapid and simplified processing and prevention of environmental pollution. However, the problem with bleaching solution containing ferric ion complex salts is that a long period of time for bleaching is required due to their weak oxidizing ability.

Accordingly, it has been proposed to add various bleach accelerating agents to the bleaching solution in order to perform sufficient bleaching processing. Among these bleach accelerating agents, the compounds represented by the general formula (II-a) or (II-b) described below are effective and when a bleaching solution to which the compound is added is employed, the period of time required for bleaching processing can be remarkably shortened, for example, it can be carried out within 6 minutes and 30 seconds, and further within 2 minutes and 30 seconds.

This fact is very preferable in view of rapid processing. However, it has been found that the photographic properties are degradated, in particular, the gradation of a cyan image is softened, in the case where the processing time for bleaching is shortened using these compounds. This problem is particularly serious in methods wherein the fixing processing is carried out directly after the bleaching processing without washing with water.

SUMMARY OF THE INVENTION

An object of the present invention is to provide an improved method for processing a silver halide color photographic light-sensitive material which is not accompanied by degradation of the photographic properties even if a bleaching processing is carried out in an extremely shortened period of time, or using an exhausted bleaching solution in a continuous processing for a long period.

Another object of the present invention is to provide an improved method for processing a silver halide color photographic light-sensitive material which is not accompanied by degradation of the photographic properties, even when a bleaching processing is carried out in an extremely shortened period of time and washing with water after the bleaching processing is eliminated and the photographic material is directly subjected to a fixing processing after the bleaching processing.

Other objects of the present invention will become apparent from the following detailed description and examples.

The above-described objects of the present invention have been attained by a method for processing a color photographic light-sensitive material comprising subjecting an imagewise exposed silver halide color photographic light-sensitive material to color development processing, then to processing with a bleaching solution and thereafter separately, to fixing processing, wherein the silver halide color photographic light-sensitive material contains a cyan dye forming coupler represented by the general formula (I-a) or (I-b) described below, the bleaching solution contains a compound represented by the general formula (II-a) or (II-b) described below.

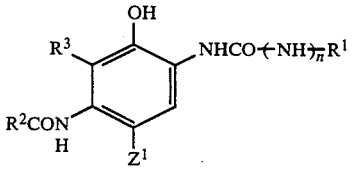

(I-a)

-continued

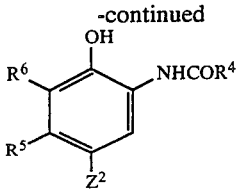

(I-b)

wherein $R^1$, $R^2$ and $R^4$ each represents a substituted or unsubstituted aliphatic group, a substituted or unsubstituted aryl group or a substituted or unsubstituted heterocyclic group; $R^3$ and $R^6$ each represents a hydrogen atom, a halogen atom, a substituted or unsubstituted aliphatic group, a substituted or unsubstituted aryl group or an acylamino group, or $R^3$ represents a nonmetallic atomic group necessary to form a nitrogen-containing 5-membered or 6-membered ring together with $R^2$; $R^5$ represents a substituted or unsubstituted alkyl group (preferably containing two or more carbon atoms in a total); $Z^1$ and $Z^2$ each represents a hydrogen atom or a group capable of being released upon the oxidative coupling reaction with a developing agent; and n represents 0 of 1;

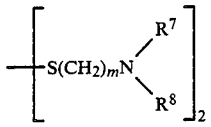

(II-a)

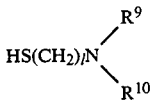

(II-b)

wherein $R^7$, $R^8$, $R^9$ and $R^{10}$, which may be the same or different, each represents a hydrogen atom, a substituted or unsubstituted lower alkyl group or an acyl group, or $R^7$ and $R^8$ or $R^9$ and $R^{10}$ may connect to each other to form a ring; and m and l each represents an integer of 1 to 3.

DETAILED DESCRIPTION OF THE INVENTION

According to the present invention, the degradation of the photographic properties can be prevented by employing the cyan dye forming coupler represented by the general formula (I-a) or (I-b) described above, even when the bleaching processing is carried out in a short period or in an exhausted bleaching solution, using the bleaching solution containing the compound represented by the general formula (II-a) or (II-b) described above.

The compounds represented by the general formula (I-a) or (I-b) are described in detail below.

In the cyan dye forming coupler represented by the general formula (I-a) or (I-b), $R^1$, $R^2$ and $R^4$ each represents an aliphatic group, preferably an aliphatic group having from 1 to 32 carbon atoms (for example, a methyl group, a butyl group, a tridecyl group, a cyclohexyl group, an alkyl group, etc.), an aryl group (for example, a phenyl group, a naphthyl group, etc.), or a heterocyclic group (for example, a 2-pyridyl group, a 2-imidazolyl group, a 2-furyl group, a 6-quinolyl group, etc.). These groups can be substituted with one or more substituents selected from an alkyl group, an aryl group, a heterocyclic group, an alkoxy group (for example, a methoxy group, a 2-methoxyethoxy group, etc.), an aryloxy group (for example, a 2,4-di-tert-amylphenoxy group, a 2-chlorophenoxy group, a 4-cyanophenoxy group, etc.), an alkenyloxy group (for example, a 2-propenyloxy group, etc.), an acyl group (for example, an acetyl group, a benzoyl group, etc.), an ester group (for example, a butoxycarbonyl group, a phenoxycarbonyl group, an acetoxy group, a benzoyloxy group, a butoxysulfonyl group, a toluenesulfonyloxy group, etc.), an amido group (for example, an acetylamino group, an ethylcarbamoyl group, a dimethylcarbamoyl group, a methanesulfonamido group, a butylsulfamoyl group, etc.), a sulfamido group (for example, a dipropylsulfamoylamino group, etc.), an imido group (for example, a succinimido group, a hydantoinyl group, etc.), an ureido group (for example, a phenylureido group, a dimethylureido group, etc.), an aliphatic or aromatic sulfonyl group (for example, a methanesulfonyl group, a phenylsulfonyl group, etc.), an aliphatic or aromatic thio group (for example, an ethylthio group, a phenylthio group, etc.), a hydroxy group, a cyano group, a carboxy group, a nitro group, a sulfo group, and a halogen atom, etc.

In the general formula (I-a), $R^3$ represents a hydrogen atom, a halogen atom, an aliphatic group, an aryl group, an acylamino group or a non-metallic atomic group necessary to form a 5-membered or 6-membered nitrogen-containing ring together with $R^2$. Of the groups, the groups which can be substituted may be substituted with one or more substituents as described for $R^1$ above.

In the general formula (I-a), n represents 0 or 1.

In the general formula (I-b), $R^5$ preferably represents an alkyl group which may be substituted contains at least two carbon atoms (for example, an ethyl group, a propyl group, a butyl group, a pentadecyl group, a tert-butyl group, a cyclohexyl group, a cyclohexylmethyl group, a phenylthiomethyl group, a dodecyloxyphenylthiomethyl group, a butanamidomethyl group, a methoxymethyl group, etc.).

In the general formula (I-b), $R^6$ represents a hydrogen atom, a halogen atom, an aliphatic group, an aryl group or an acylamino group.

In the general formulae (I-a) and (I-b), $Z^1$ and $Z^2$ each represents a hydrogen atom or a group capable of being released upon coupling. Examples of the groups capable of being released upon coupling include a halogen atom (for example, a fluorine atom, a chlorine atom, a bromine atom, etc.), an alkoxy group (for example, an ethoxy group, a dodecyloxy group, a methoxyethylcarbamoylmethoxy group, a carboxypropyloxy group, a methylsulfonylethoxy group, etc.), an aryloxy group (for example, a 4-chlorophenoxy group, a 4-methoxyphenoxy group, a 4-carboxyphenoxy group, etc.), an acyloxy group (for example, an acetoxy group, a tetradecanoyloxy group, a benzoyloxy group, etc.), a sulfonyloxy group (for example, a methanesulfonyloxy group, a toluenesulfonyloxy group, etc.), an amido group (for example, a carbonamido group such as a dichloroacetylamino group, and a heptafluorobutyrylamino group; a sulfonamido group such as a methanesulfonylamino group, and a toluenesulfonylamino group; etc.), an alkoxycarbonyloxy group (for example, an ethoxycarbonyloxy group, a benzyloxycarbonyloxy group, etc.), an aryloxycarbonyloxy group (for example, a phenoxycarbonyloxy group, etc.), an aliphatic or aromatic thio group (for example, an ethylthio group, a phenylthio group, a tetrazolylthio group, etc.), an imido group (for example, a succinimido group, a hydantoinyl group, etc.), an aromatic azo group (for example, a phenylazo group, etc.) and the like. These groups may contain a photographically useful group.

In the general formula (I-a), $R^1$ is preferably a substituted or unsubstituted aryl group or a substituted or unsubstituted heterocyclic group. An aryl group substituted with one or more substituents selected from a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group and a cyano group is more preferred for $R^1$.

In the general formula (I-a), when $R^3$ and $R^2$ do not connect to each other to form a ring, $R^2$ is preferably a substituted or unsubstituted alkyl group or a substituted or unsubstituted aryl group and particularly preferably an alkyl group substituted with a substituted aryloxy group, and $R^3$ is preferably a hydrogen atom.

In the general formula (I-b), $R^4$ is preferably a substituted or unsubstituted alkyl group or a substituted or unsubstituted aryl group. An alkyl group substituted with a substituted aryloxy group is particularly preferred for $R^4$.

In the general formula (I-b), $R^5$ is preferably an alkyl group having from 2 to 15 carbon atoms or a methyl group substituted with a substituent having at least one carbon atom. Preferred examples of the substituents for the methyl group include an arylthio group, an alkylthio group, an acylamino group, an aryloxy group and an alkyloxy group.

In the general formula (I-b), $R^5$ is more preferably an alkyl group having from 2 to 15 carbon atoms. An alkyl group having from 2 to 4 carbon atoms is particularly preferred for $R^5$.

In the general formula (I-b), $R^6$ is preferably a hydrogen atom or a halogen atom. A chlorine atom or a fluorine atom is particularly preferred for $R^6$.

In the general formula (I-a) or (I-b), $Z^1$ or $Z^2$ is preferably a hydrogen atom, a halogen atom, an alkoxy group, an aryloxy group, an acyloxy group or a sulfonamido group.

In the general formula (I-b), $Z^2$ is more preferably a halogen atom. A chlorine atom or a fluorine atom is particularly preferred.

In the general formula (I-a), when n is 0, $Z^1$ is more preferably a halogen atom. A chlorine atom or a fluorine atom is particularly preferred.

Specific examples of the compounds represented by the general formula (I-a) or (I-b) according to the present invention will now be set forth below, but the present invention should not be construed as being limited thereto.

(C-1)

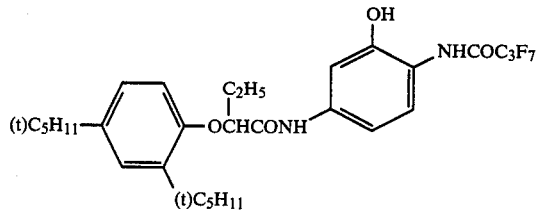

(C-2)

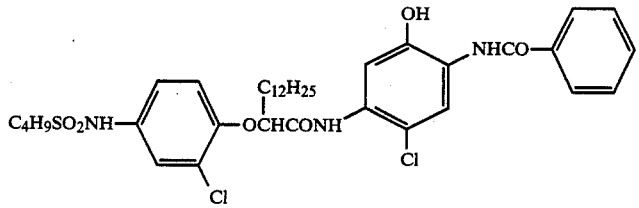

(C-3)

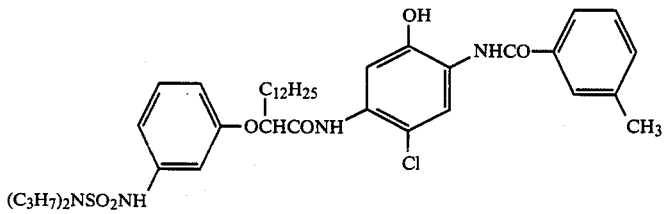

(C-4)

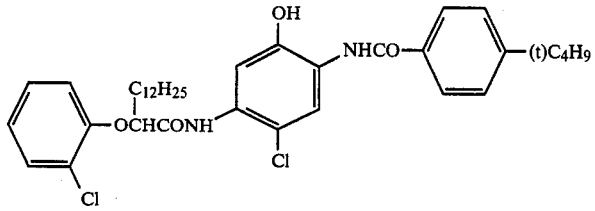

-continued
(C-5)
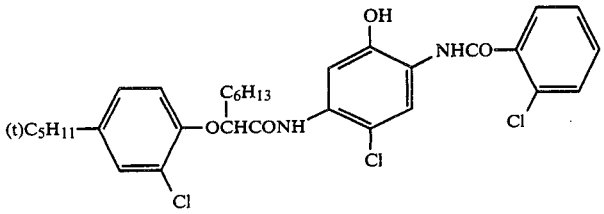
(C-6)
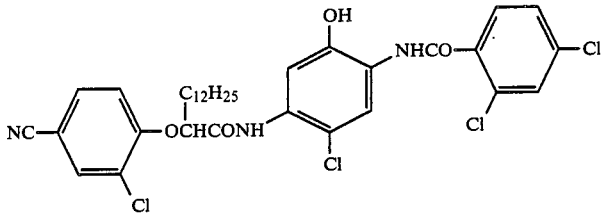
(C-7)
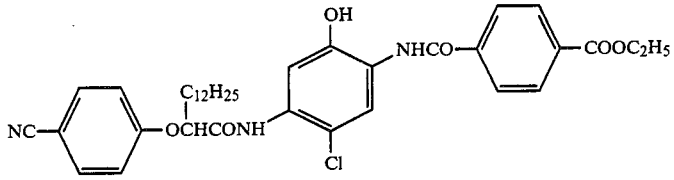
(C-8)
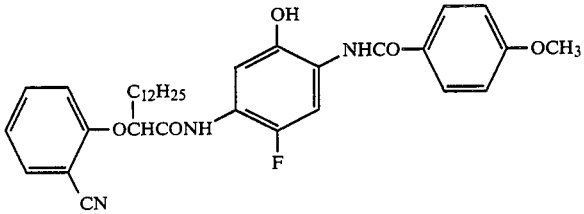
(C-9)
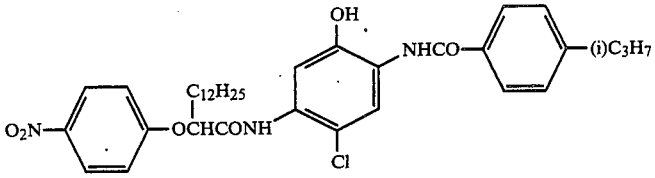
(C-10)
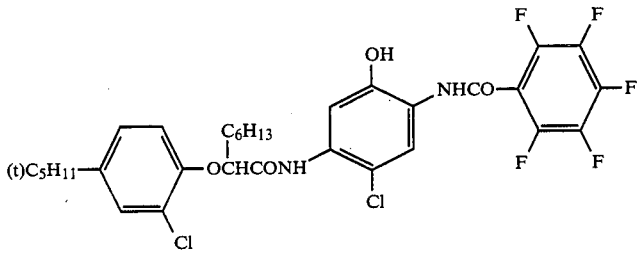
(C-11)
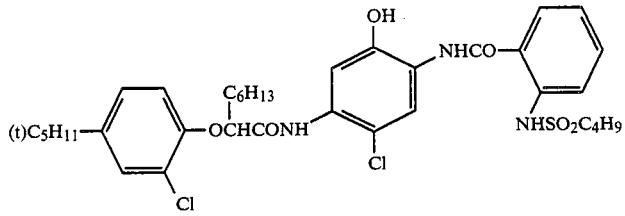

-continued
(C-12)
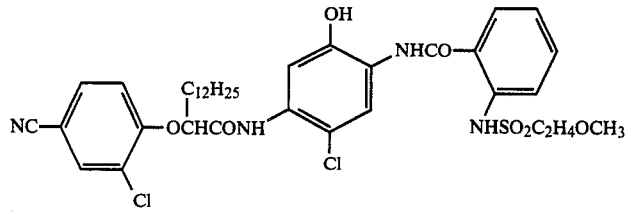
(C-13)
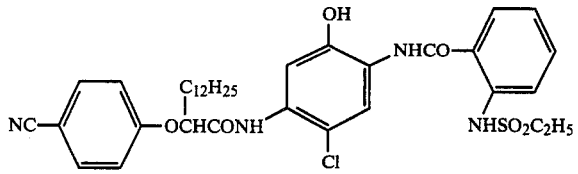
(C-14)
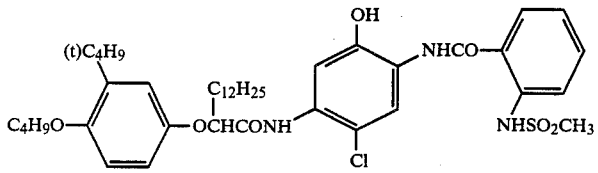
(C-15)
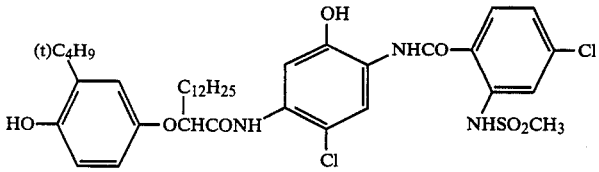
(C-16)
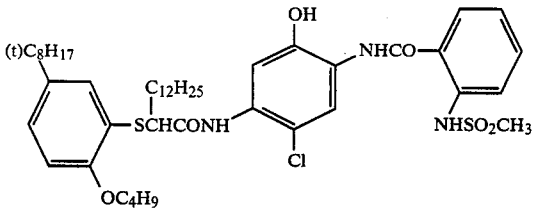
(C-17)
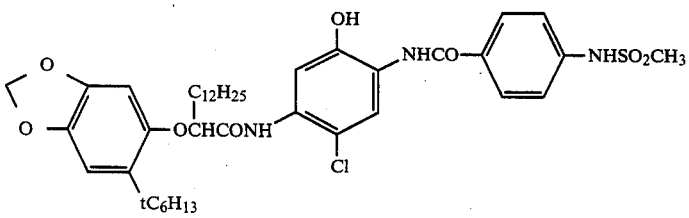
(C-18)
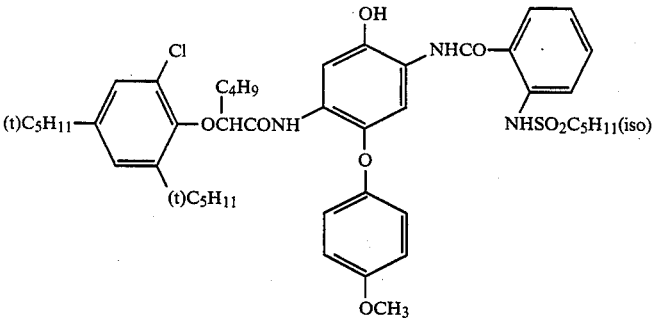

-continued
(C-19)
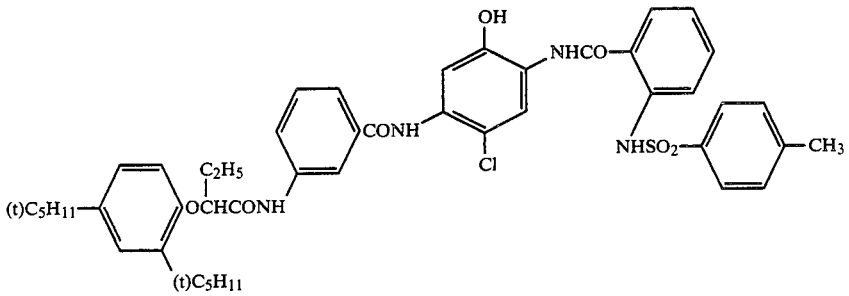
(C-20)
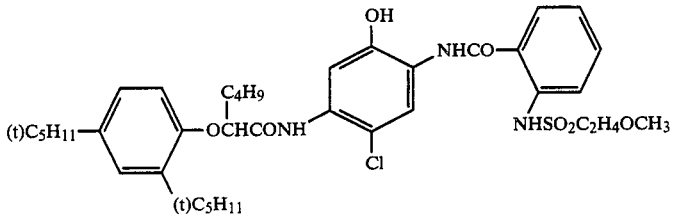
(C-21)
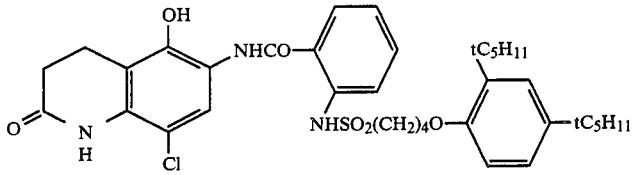
(C-22)
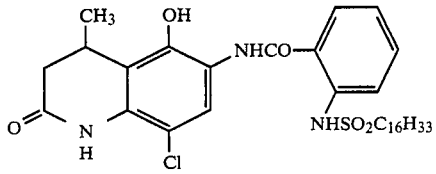
(C-23)
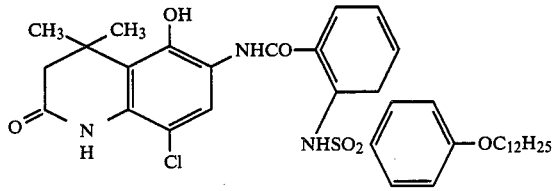
(C-24)
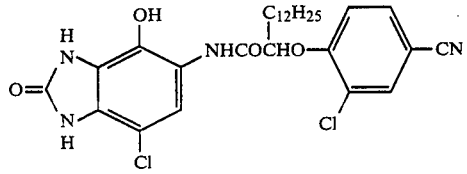
(C-25)
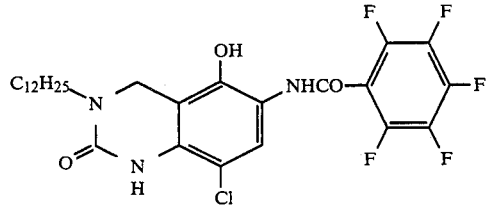

-continued
(C-26)
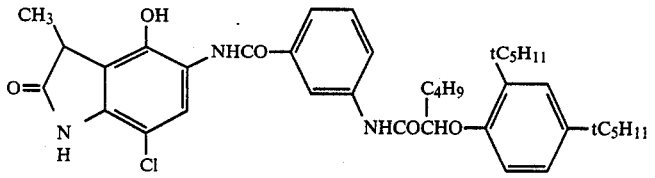
(C-27)
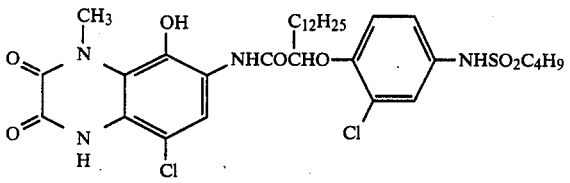
(C-28)
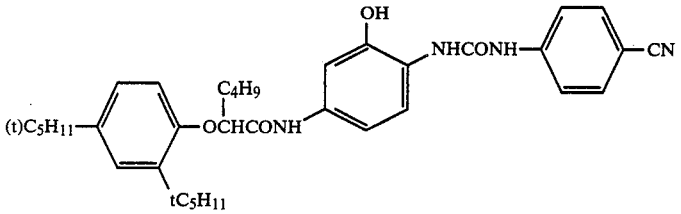
(C-29)
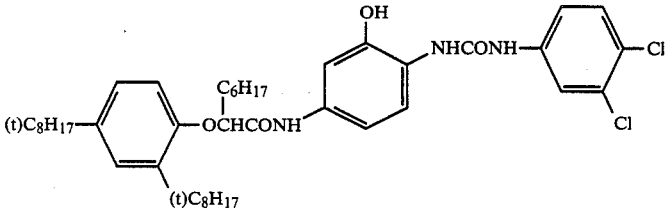
(C-30)
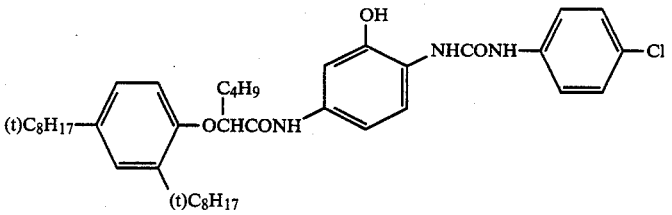
(C-31)
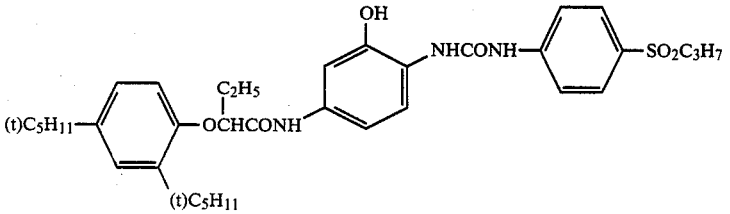
(C-32)
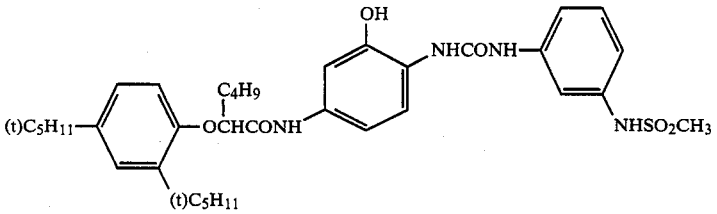

-continued
(C-33)
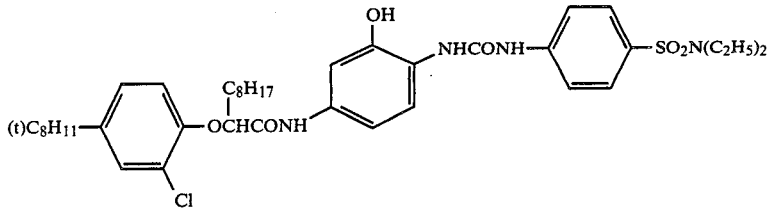
(C-34)
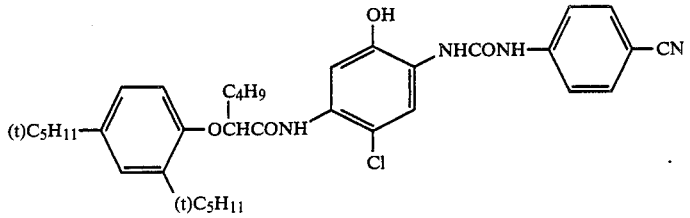
(C-35)
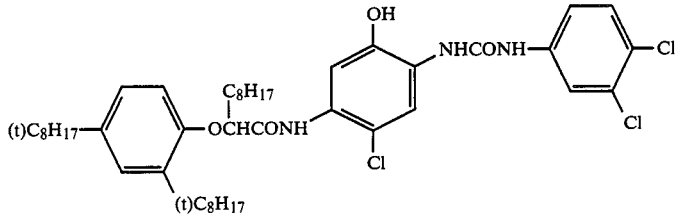
(C-36)
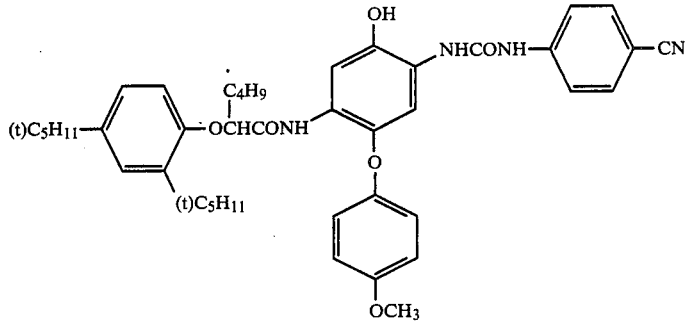
(C-37)
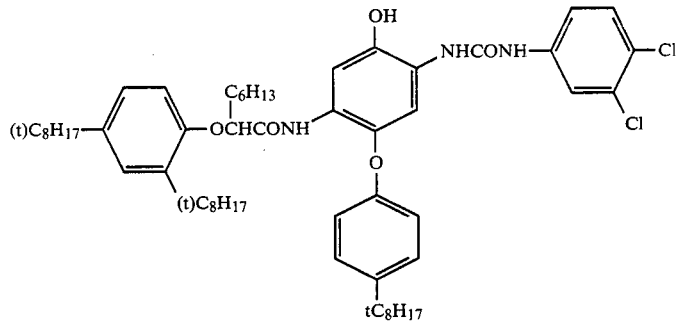

-continued
(C-38)
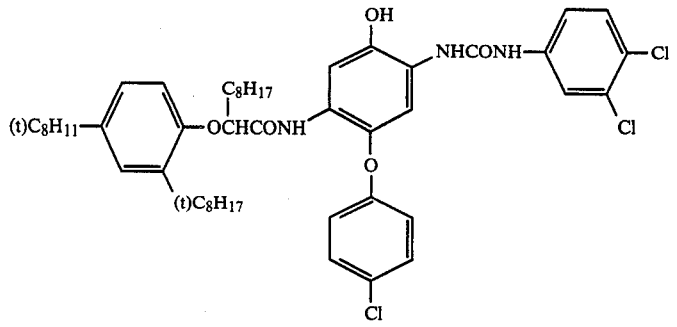
(C-39)
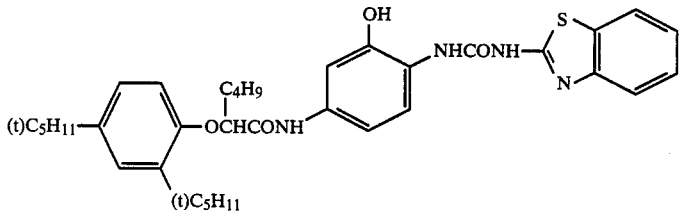
(C-40)
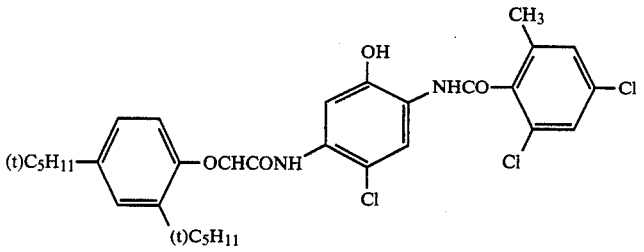
(C-41)
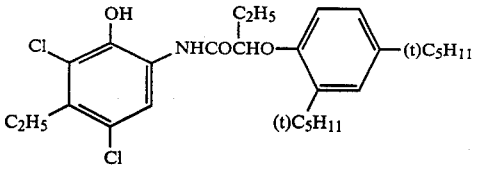
(C-42)
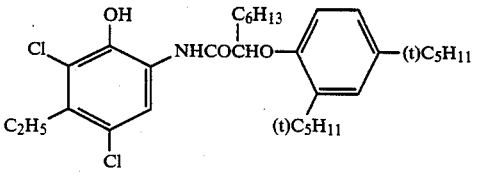
(C-43)
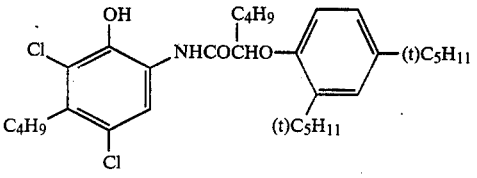
(C-44)
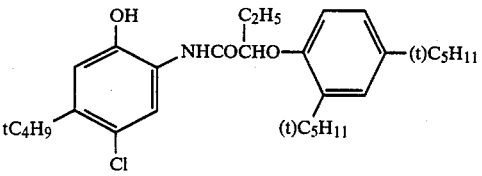

-continued (C-45)

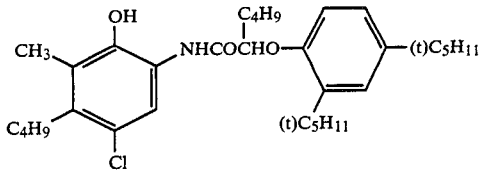

(C-46)

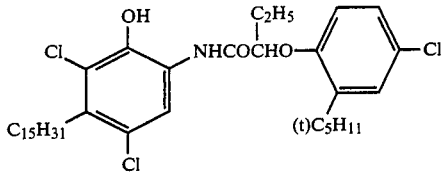

(C-47)

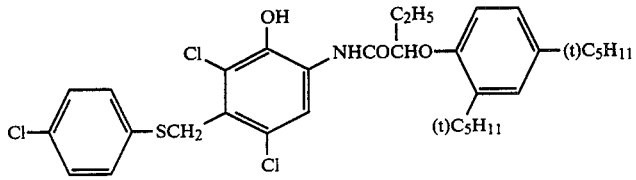

(C-48)

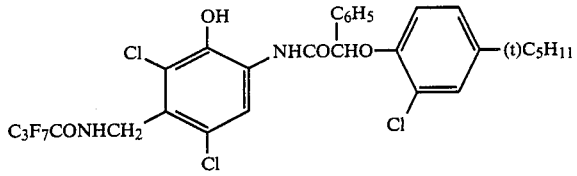

(C-49)

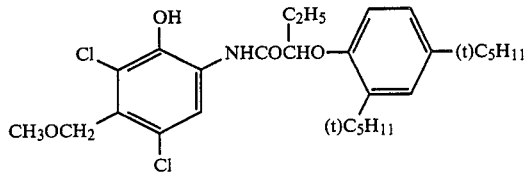

(C-50)

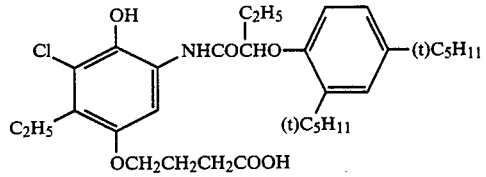

The cyan dye forming couplers represented by the general formula (I-a) or (I-b) are ordinarily employed in a silver halide emulsion layer, particularly in a red-sensitive emulsion layer. The amount of the cyan dye forming coupler to be added is in a range from $2\times10^{-3}$ to $5\times10^{-1}$ mol, preferably from $1\times10^{-2}$ to $5\times10^{-1}$ mol, per mol of silver.

The cyan dye forming couplers represented by the general formula (I-a) or (I-b) can be easily synthesized with reference to the methods as described in U.S. Pat. Nos. 3,772,002, 4,334,011, 4,327,173 and 4,427,767, etc.

The compounds represented by the general formula (II-a) or (II-b) can be synthesized by known methods. More specifically, the compounds represented by the general formula (II-a) can be synthesized with reference to the methods as described in Japanese Patent Application (OPI) No. 95630/78; and the compounds represented by the general formula (II-b) can be synthesized with reference to the methods as described in U.S. Pat. No. 4,285,984, G. Schwarzenbach et al., *Helv. Chim. Acta.*, Vol. 38, page 1147 (1955), and R. O. Clinton et al., *J. Am. Chem. Soc.*, Vol. 70, p. 950 (1948).

In the general formulas (II-a) and (II-b), $R_7$ to $R_{10}$ preferably stand for lower alkyl group such as methyl group, ethyl group and propyl group; acyl group such as formyl group, acetyl group and propionyl group, and substituting group such as hydroxyl group and carbonyl group. The total carbon number of these groups is preferably 5 or less.

Specific examples of the compounds represented by the general formula (II-a) or (II-b) according to the present invention are set forth below, but the present invention should not be construed as being limited thereto.

(II-a)-(1)

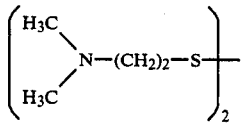

(II-a)-(2)

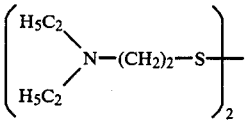

(II-a)-(3)

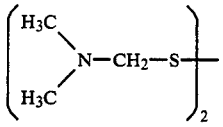

(II-a)-(4)

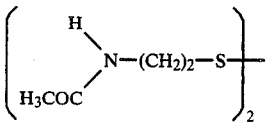

(II-a)-(5)

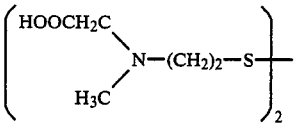

(II-a)-(6)

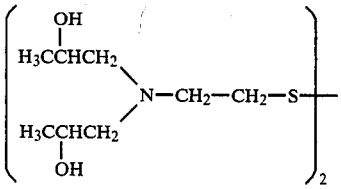

(II-a)-(7)

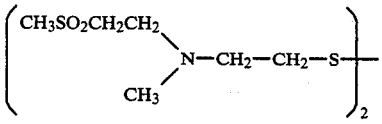

(II-a)-(8)

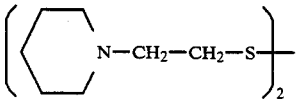

(II-b)-(1)

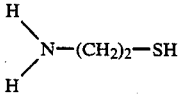

(II-b)-(2)

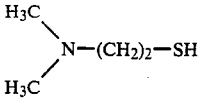

(II-b)-(3)

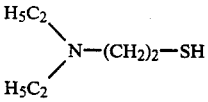

(II-b)-(4)

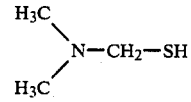

-continued (II-b)-(5)

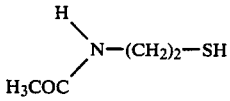

(II-b)-(6)

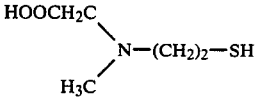

(II-b)-(7)

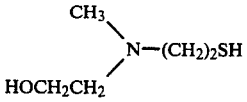

The amount of the bleach accelerating agent represented by the general formula (II-a) or (II-b) according to the present invention to be added to the bleaching solution varies depending upon the kind of processing solution, kind of photographic material to be processed, processing temperature, etc. However, an amount of $1\times10^{-5}$ to $1\times10^{-1}$ mol per liter of a processing solution is preferable, with $1\times10^{-4}$ to $5\times10^{-2}$ mol being more preferable.

The bleach accelerating agents according to the present invention are generally added to a processing solution by previously dissolving them in water, an alkali, an organic acid, an organic solvent, or the like. If necessary, the bleach accelerating agents may be directly added to the bleaching solution in the form of powder without adversely affecting their bleach accelerating effects.

In the bleaching solution according to the present invention, a ferric ion complex is employed as a bleaching agent. The ferric ion complex, one of the bleaching agents, is a complex of ferric ion and a chelating agent such as an aminopolycarboxylic acid, an aminopolyphosphonic acid or the salt thereof. Aminopolycarboxylic acid salts or aminopolyphosphonic acid salts are alkali metal salts, ammonium salts or water-soluble amine salts of aminopolycarboxylic acids or aminopolyphosphonic acids. The alkali metals include sodium, potassium, lithium, etc., and water-soluble amines include alkylamines (e.g., methylamine, diethylamine, triethylamine, butylamine, etc.), alicyclic amines (e.g., cyclohexylamine), arylamines (e.g., aniline, m-toluidine, etc.), and heterocyclic amines (e.g., pyridine, morpholine, piperidine, etc.).

Typical examples of the chelating agents of these aminopolycarboxylic acids, aminopolyphosphonic acids, and the salts thereof are:

Ethylenediaminetetraacetic acid,
Disodium ethylenediaminetetraacetate,
Diammonium ethylenediaminetetraacetate,
Tetra(trimethylammonium) ethylenediaminetetraacetate,
Tetrapotassium ethylenediaminetetraacetate;
Tetrasodium ethylenediaminetetraacetate,
Trisodium ethylenediaminetetraacetate,
Diethylenetriaminepenetaacetic acid,
Pentasodium diethylenetraminepentaacetate,
Ethylenediamine-N-(β-oxyethyl)-N,N',N'-triacetic acid,
Trisodium ethylenediamine-N-(β-oxethyl)-N,N',N'-triacetate, Triammonium ethylenediamine-N-(β-oxyethyl)-N,N',N'-triacetate,
Propylenediaminetetraacetic acid,
Disodium propylenediaminetetraacetate,
Nitrilotriacetic acid,
Trisodium nitrilotriacetate,
Cyclohexanediaminetetraacetic acid,
Disodium cyclohexanediaminetetraacetate,
Iminodiacetic acid,
Dihydroxyethylglycine,
Ethyl ether diaminetetraacetic acid,
Glycol ether diaminetetraacetic acid,
Ethylenediaminetetrapropionic acid,
Phenylenediaminetetraacetic acid,
1,3-Diaminopropanol-N,N,N',N'-tetramethylenephosphonic acid,
Ethylenediamine-N,N,N',N'-tetramethylenephosphonic acid,
1,3-Propylenediamine-N,N,N',N'-tetramethylenephosphonic acid, etc.

The present invention is not limited to the above-illustrated chelating agents.

The ferric ion complex salts may be used in the form of the complex salt or may be formed in situ in a solution by using a ferric salt (e.g., ferric sultate, ferric chloride, ferric nitrate, ferric ammonium sulfate or ferric phsophate, etc.) and a chelating agent (e.g., aminopolycarboxylic acid, aminopolyphosphonic acid or phosphonocarboxylic acid, etc.). When they are used in the form of a complex salt, they may be used alone or in combination of two or more. On the other hand, where a complex is formed in situ in a solution by using a ferric salt and a chelating agent, one, two or more ferric salts may be used. Further, one, two or more chelating agents may also be used. In every case, a chelating agent may be used in an amount more than is necessary for forming a ferric ion complex salt.

A bleaching solution containing the above-described ferric ion complex may further contain complexes of other metals than iron such as cobalt or copper or hydrogen peroxide.

The bleaching solution according to the present invention can contain rehalogenating agents such as bromides (e.g., potassium bromide, sodium bromide, ammonium bromide, etc.), chlorides (e.g., potassium chloride, sodium chloride, ammonium chloride, etc.), and the like in addition to the bleaching agents such as ferric ion complex salts, etc., and the above-described compounds. Further, additives which have a pH buffering ability such as inorganic acids, organic acids, or the salts thereof which are known to be used in ordinary bleaching solutions (e.g., boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc.) may be added.

Further, the bleaching solution according to the present invention may contain the compound represented by the general formula (III-a) or (III-b) described below in order to prevent the formation of precipitate in the bleaching solution when color photographic light-sensitive materials are continuously processed.

(III-a)

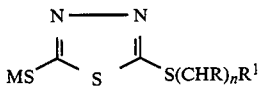

-continued (III-b)

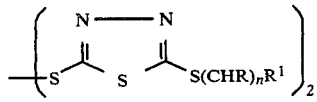

wherein M represents a hydrogen atom, an alkali metal atom or an ammonium ion; R represents a hydrogen atom, a substituted or unsubstituted alkyl group, $-SO_3M^1$ or $-COOM^1$; $R^1$ represents $-SO_3M^1$ or $-COOM^1$; $M^1$ represents a hydrogen atom, an alkali metal atom or an ammonium ion; and n represents an integer from 1 to 6 and when n is 2 or more, each R may be the same or different.

Specific examples of the compounds represented by the general formula (III-a) or (III-b) are set forth below, but the present invention should not be construed as being limited thereto.

(III-a)-(1)

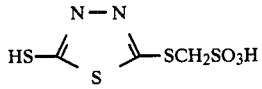

(III-a)-(2)

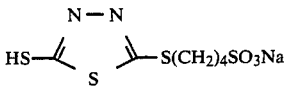

(III-a)-(3)

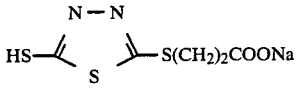

(III-b)-(1)

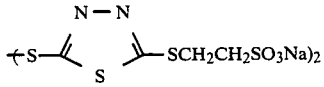

The amount of bleaching agent is from 0.1 to 2 mols per liter of the bleaching solution, and the pH of the bleaching solution is desirably from 3.0 to 8.0, particularly from 4.0 to 7.0, when a ferric ion complex salt is used.

According to the present invention, the bleaching may be satisfactorily processed for 6 minutes and 30 seconds or less, and when other cyan dye forming couplers than those of the present invention are used, photographic properties are markedly degradated.

Further, when photographic light-sensitive materials are processed at a period of 2 minutes and 30 seconds or less using a bleaching solution which does not contain the compound represented by the general formula (II-a) or (II-b), silver removing proceeds insufficiently and developed silver remains together with the dye images in the photographic materials resulting in the degradation of the photographic properties.

That is, only in case of using the compound represented by the general formula (I-a) or (I-b) as a cyan dye forming coupler and processing in a short period, for example substantially 6 minutes and 30 seconds or less with a bleaching solution containing the compound represented by the general formula (II-a) or (II-b) is the silver completely removed and color photographic images having good photographic properties are obtained.

The term "substantially 6 minutes and 30 seconds" means a period of time from when the color photographic material is contacted with the bleaching solution to when it is contacted to the following processing solution, that is, the total amount of time when the color photographic material is present in the bleaching solution and the time when it is present in air between the bleaching solution and the following processing solution. Employable shorter period for bleaching is 3 minutes and 30 seconds or less and a further shorter period for bleaching is 2 minutes and 30 seconds or less. Most preferred bleaching time is from 30 seconds to 2 minutes and 30 seconds.

The bleaching processing is usually carried out a temperature from 25° C. to 50° C.

Primary aromatic amine type color developing agents to be used in the present invention in a color developing solution include a wide range of known ones for use in various color photographic processes. The developing agents include aminophenol derivatives and p-phenylenediamine derivatives. These compounds are generally used in the form of salts such as hydrochlorides or sulfates rather than in free form in view of stability. They are generally used in an amount of from about 0.1 g to about 30 g, more preferably from about 1 g to about 15 g, per liter of color developing solution.

The aminophenol type developing agents include, for example, o-aminophenol, p-aminophenol, 5-amino-2-oxytoluene, 2-amino-3-oxytoluene, 2-oxy-3-amino-1,4-dimethylbenzene, etc.

Particularly useful primary aromatic amine type color developing agents are N,N-dialkyl-p-phenylenediamine compounds wherein the alkyl group and the phenyl group may or may not be substituted. Of these, particularly useful compounds are N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ethyl-N-β-methanesulfonamidoethyl-3-methyl-4-aminoaniline sulfate, N-ethyl-N-β-hydroxyethylaminoaniline, 4-amino-3-methyl-N,N-diethylaniline, 4-amino-N-(2-methoxyethyl)-N-ethyl-3-methylaniline-p-toluenesulfonate, etc.

The alkaline color developing solution to be used in the present invention can optionally contain, in addition to the above-described primary aromatic amine type color developing agent, various ingredients usually added to a color developing solution, such as alkali agents (e.g., sodium hydroxide, sodium carbonate, potassium carbonate, etc.), alkali metal sulfites, alkali metal bisulfites, alkali metal thiocyanates, alkali metal halides, benzyl alcohol, water-softening agents, thickening agents, etc. The pH of the color developing solution is usually about 7 or above, more generally from about 9 to about 13.

The process of the present invention is applicable to color reversal processing. In the present invention, as a black-and-white developing solution to be used in this processing, a black-and-white first developing solution used for reversal processing of color photographic light-sensitive materials or that to be used for processing black-and-white photographic light-sensitive materials can be used. In addition, various well known additives generally added to a black-and-white developing solution can be incorporated in the solution.

Typical additives include developing agents such as 1-phenyl-3-pyrazolidone, Metol, and hydroquinone; preservatives such as sulfites; accelerating agents comprising an alkali such as sodium hydroxide, sodium carbonate, or potassium carbonate; inorganic or organic inhibitors such as potassium bromide, 2-methylbenzimidazole, methylbenzothiazole, etc.; water-softening agents such as polyphosphoric acid salts; and slight amounts of development restrainers comprising an iodide or a mercapto compound.

The method of processing according to the present invention comprises, in addition to the above-described color development and bleaching, a processing step such as fixing. After the fixing step, or the bleach-fixing step it is general to carry out other processing step such as washing with water and stabilizing. However, a simple processing method wherein after the fixing step or the bleach fixing step, substantial washing with water is not conducted but only a stabilizing processing is carried out may also be employed.

The washing water used in the washing process may contain known additives as necessary. For example, chelating agents such as inorganic phosphoric acid, amino polycarboxylic acid, and organic phosphoric acid, sterilizers or antifungal agent for preventing proliferation of various bacteria and algae, hardners such as magnesium and aluminum salts, and surface active agents for preventing dry load and nonuniformity may be used. Furthermore, compounds described in L. E. West, "Water Quality Criteria" Phot. Sci. and Eng., vol. 9, No. 6 page 344–359 (1965) may be used.

The washing process may be effected using more than two tanks as necessary. For example, a multi-stage countercurrent washing process (e.g. 2 to 9 stages) may be used to save the washing water.

As the stabilizing solution used in the stabilizing process there may be employed a treating liquid for stabilizing dye images. For example, liquids having a buffer action for maintaining the pH value at 3 to 6 or containing an aldehyde such as formaldehyde may be used. The stabilizing solution may contain an optical whitening agent, chelating agent, sterilizer, antifungal agent, hardner, surface active agent or the like as necessary.

The stabilizing process may be effected using more than two tanks as necessary. For example, a multi-stage countercurrent stabilizing process (e.g. 2 to 9 stages) may be used to save the stabilizing solution and hence the washing process.

Silver halide color photographic light-sensitive materials to be processed according to the present invention in the presence of the compound according to the present invention are known color photographic light-sensitive materials. The present invention is particularly advantageous for processing coupler-containing multilayer negative type color photographic light-sensitive materials or for processing color photographic light-sensitive materials designed to be subjected to reversal color processing. In addition, color X-ray photographic light-sensitive materials, monolayer special color photographic light-sensitive materials, and color photographic light-sensitive materials containing a black-and-white developing agents such as a 3-pyrazolidone as described in U.S. Pat. Nos. 2,751,297 and 3,902,905, Japanese Patent Application (OPI) Nos. 64339/81, 85748/81 and 85749/81, and a color developing agent precursor as described in U.S. Pat. Nos. 2,478,400, 3,342,597, 3,342,599, 3,719,492 and 4,214,047, Japanese Patent Application (OPI) No. 135628/78 can be processed according to the present invention. Further, the processing may be conducted by allowing a coupler to exist in a developing solution.

In a photographic emulsion layer of color photographic light-sensitive material used in the present invention, any of silver bromide, silver iodobromide, silver iodochlorobromide, silver chlorobromide, and silver chloride may be used as a silver halide.

The photographic emulsion to be used in the present invention can be prepared by the processes as described in P. Glafkides, *Chimie et Physique Photographique* (Paul Montel, 1967), G. F. Duffin, *Photographic Emulsion Chemistry* (The Focal Press, 1966), V. L. Zelikman et al., *Making and Coating Photographic Emulsion* (The Focal Press, 1964), etc.

During formation or physical ripening of silver halide grains, cadmium salts, zinc salts, lead salts, thallium salts, iridium salts or the complex salts thereof, rhodium salts or the complex salts thereof, iron salts or the complex salts thereof, etc., may be allowed to coexist.

Silver halide emulsions may be used as so-called primitive emulsions without conducting chemical sensitization, but are usually chemically sensitized. Chemical sensitization can be conducted according to the processes as described in the above-described books by Glafkides or Zelikman et al. or in H. Frieser, *Die Grundlagen der Photographischen Prozesse mit Silberhalogeniden* (Akademische Verlagsgesellschaft, 1968).

That is, sulfur sensitization using sulfur-containing compounds capable of reacting with silver ion or active gelatin, reduction sensitization using a reductive substance, and noble metal sensitization using compounds of noble metals such as gold or etc. can be employed alone or in combination. Examples of useful sulfur sensitizers include thiosulfates, thioureas, thiazoles, rhodanines, and other compounds. Examples of useful reduction sensitizers include stannous salts, amines, hydrazine derivatives, formamidinesulfinic acids and silane compounds. For noble metal sensitization, complexes of the Group VIII metals in the Periodic Table such as platinum, iridium, palladium, etc., can be used as well as gold complexes.

Photographic emulsions may be spectrally sensitized with methine dyes or the like. Dyes to be used include cyanine dyes, merocyanine dyes, complex cyanine dyes, complex merocyanine dyes, holopolar cyanine dyes, hemicyanine dyes, styryl dyes, and hemioxonol dyes. Particularly useful dyes are those belonging to cyanine dyes, merocyanine dyes, and complex merocyanine dyes.

In addition to a silver halide emulsion layer having the above-described light sensitivity, a substantially light-insensitive fine grain silver halide emulsion layer for the purpose of improving graininess or sharpness or for other purposes can be included. Such substantially light-insensitive fine grain emulsion layer can be provided on the light-sensitive silver halide emulsion layer or between the light-sensitive silver halide emulsion layer and a colloidal silver layer (yellow filter layer or antihalation layer).

The photographic light-sensitive material according to the present invention may contain a polyalkylene oxide or its ether, ester or amine derivatives, a thioether compound, a thiomorpholine, a quaternary ammonium salt compound, a urethane derivative, a urea derivative, an imidazole derivative, a 3-pyrazolidone, etc., for the purpose of increasing sensitivity or contrast or for accelerating development.

As binders for photographic emulsion layers or other constituent layers gelatin is advantageously employed, but other hydrophilic colloids may also be used.

Various compounds may be incorporated in the photographic light-sensitive material according to the present invention as antifoggants or stabilizers. That is, many compounds known as antifoggants or stabilizers such as azoles (e.g., benzothiazolium salts, nitroindazoles, triazoles, benzotriazoles, benzimidazoles (particularly, nitro- or halogen-substituted derivatives), etc.); heterocyclic mercapto compounds (e.g., mercaptothiazoles, mercaptobenzothiazoles, mercaptobenzimidazoles, mercaptothiadiazoles, mercaptotetrazoles (e.g., 1-phenyl-5-mercaptotetrazole), and mercaptopyrimidines); heterocyclic mercapto compounds having a water-soluble group such as a carboxy group or a sulfo group; thioketo compounds (e.g., oxazolinethione); azaindenes (e.g., tetraazaindenes (particularly 4-hydroxy-substituted (1,3,3a,7)tetraazaindenes); benzenethiosulfonic acids; benzenesulfinic acids; etc., can be added.

The photographic light-sensitive material according to the present invention may contain an organic or inorganic hardener in its photographic emulsion layers or other constituent layers. For example, chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), etc., can be used alone or in combination.

The photographic light-sensitive material according to the present invention may contain in its photographic emulsion layers or other constituent layers various surfactants for various purposes such as coating aids or improvement of antistatic properties, slipping properties, emulsion dispersibility, anti-adhesion properties, and photographic properties (for example, development acceleration, increase in contrast, sensitization, etc.).

The photographic light-sensitive material according to the present invention may contain in its photographic emulsion layers color forming couplers, that is, compounds capable of forming color by oxidative coupling with an aromatic primary amine developing agent (for example, a phenylenediamine derivative or an aminophenol derivative) in color development processing. For example, magenta couplers include 5-pyrazolone coupler, pyrazolobenzimidazole coupler, cyanoacetylcoumarone coupler, open chain acylacetonitrile coupler, etc., yellow couplers include acylacetamide couplers (e.g., benzoylacetanilides, pivaloylacetanilides, etc.), in addition to the cyan dye forming couplers according to the present invention.

Further, the cyano dye forming couplers represented by the general formula (I-a) or (I-b) can be employed together with known phenol or naphthol cyan couplers. These couplers may be polymerized. Of these couplers, nondiffusible couplers having a hydrophobic group called ballast group in their molecule are desirable. The couplers may be of either 4-equivalent type or 2-equivalent type to silver ion. Colored couplers having color correcting effect or couplers capable of releasing a development inhibitor upon development (so-called DIR couplers) may also be used. In addition to DIR couplers, non-color forming DIR coupling compounds capable of forming a colorless coupling reaction product and releasing a development inhibitor, and DIR redox compounds may also be incorporated.

The photographic light-sensitive material according to the present invention can contain a developing agent, including those described in *Research Disclosure,* Vol. 176, page 29 under the item of "Developing agents".

The photographic light-sensitive material according to the present invention may contain a dye in its photographic emulsion layers or other constituent layers as a filter dye or for various purposes such as prevention of irradiation. Examples of such dyes include those described in *Research Disclosure,* Vol. 176, pages 25 to 26 under the item of "Absorbing and filter dyes".

The photographic light-sensitive material according to the present invention can further contain antistatic agents, plasticizers, matting agents, lubricants, ultraviolet ray absorbing agents, fluorescent brightening agents, air fog preventing agents, etc., including those described in *Research Disclosure,* Vol. 170 pages 22 to 27 (1978).

Silver halide emulsion layers and/or other constituent layers are coated on a support by a procedure such as described in *Research Disclosure,* Vol. 176, pages 27 and 28, under the item of "Coating procedures".

The present invention is illustrated in greater detail with reference to the following examples, but the present invention is not to be construed as being limited thereto.

EXAMPLE 1

On a polyethylene terephthalate film support were coated layers having the compositions set forth below to prepare a multilayer color photographic light-sensitive material.

First Layer: Antihalation Layer
- A gelatin layer containing black colloidal silver Second Layer: Intermediate Layer
- A gelatin layer containing a dispersion of 2,5-di-tert-octylhydroquinone Third Layer: Low Speed Red-Sensitive Emulsion Layer
- A silver iodobromide emulsion (iodide content: 5 mol%), silver coated amount: 1.6 g/m$^2$
- Sensitizing Dye I: $6\times10^{-5}$ mol per mol of silver
- Sensitizing Dye II: $1.5\times10^{-5}$ mol per mol of silver
- Coupler as shown in Table 1 below: 0.04 mol per mol of silver
- Coupler EX-5: 0.003 mol per mol of silver
- Coupler EX-6: 0.0006 mol per mol of silver Fourth Layer: High Speed Red-Sensitive Emulsion Layer
- A silver iodobromide emulsion (iodide content: 10 mol%), silver coated amount: 1.4 g/m$^2$
- Sensitizing Dye I: $3\times10^{-5}$ mol per mol of silver
- Sensitizing Dye II: $1.2\times10^{-5}$ mol per mol of silver
- Coupler EX-2: 0.02 mol per mol of silver
- Coupler EX-5: 0.0016 mol per mol of silver Fifth Layer: Intermediate Layer
- Same as the Second Layer Sixth Layer: Low Speed Green-Sensitive Emulsion Layer
- A silver iodobromide emulsion (iodide content: 4 mol%), silver coated amount: 1.2 g/m$^2$
- Sensitizing Dye III: $3\times10^{-5}$ mol per mol of silver
- Sensitizing Dye IV: $1\times10^{-5}$ mol per mol of silver
- Coupler EX-4: 0.05 mol per mol of silver
- Coupler EX-8: 0.008 mol per mol of silver
- Coupler EX-6: 0.0015 mol per mol of silver Seventh Layer: High Speed Green-Sensitive Emulsion Layer
- A silver iodobromide emulsion (iodide content: 10 mol%), silver coated amount: 1.3 g/m$^2$
- Sensitizing Dye III: $2.5\times10^{-5}$ mol per mol of silver
- Sensitizing Dye IV: $0.8\times10^{-5}$ mol per mol of silver
- Coupler EX-3: 0.017 mol per mol of silver
- Coupler EX-8: 0.003 mol per mol of silver
- Coupler EX-10: 0.003 mol per mol of silver Eighth Layer: Yellow Filter Layer
- A gelatin layer containing yellow colloidal silver and a dispersion of 2,5-di-tert-octylhydroquinone Ninth Layer: Low Speed Blue-Sensitive Emulsion Layer
- A silver iodobromide emulsion (iodide content: 6 mol%), silver coated amount: 0.7 g/m$^2$
- Coupler EX-9: 0.25 mol per mol of silver
- Coupler EX-6: 0.015 mol per mol of silver Tenth Layer: High Speed Blue-Sensitive Emulsion Layer
- A silver iodobromide emulsion (iodide content: 6 mol%), silver coated amount: 0.6 g/m$^2$
- Coupler EX-9: 0.06 mol per mol of silver Eleventh Layer: First Protective Layer
- A gelatin layer containing silver iodobromide (iodide content: 1 mol%, average particle size: 0.07$\mu$), silver coated amount: 0.5 g/m$^2$ and a dispersion of Ultraviolet Ray Absorbing Agent UV-1

Twelfth Layer: Second Protective Layer
- A gelatin layer containing polymethyl methacrylate particles (having a diameter of about 1.5$\mu$)

Gelatin Hardener H-1 and a surface active agent were incorporated into each of the layers in addition to the above-described components.

The compounds used for preparing the sample are as follows:

Sensitizing Dye I: Pyridinium salt of anhydro-5,5'-dichloro-3,3'-di($\gamma$-sulfopropyl)-9-ethylthiacarbocyanine hydroxide Sensitizing Dye II: Triethylamine salt of anhydro-9-ethyl-3,3'-di($\gamma$-sulfopropyl)-4,5,4',5'-dibenzothiacarbocyanine hydroxide Sensitizing Dye III: Sodium salt of anhydro-9-ethyl-5,5'-dichloro-3,3'-di($\gamma$-sulfopropyl)oxacarbocyanine Sensitizing Dye IV: Sodium salt of anhydro-5,6,5',6'-tetrachloro-1,1'-diethyl-3,3'-di{$\beta$-[$\beta$-($\gamma$-sulfopropyl)-ethoxy]ethyl}imidazolocarbocyanine hydroxide

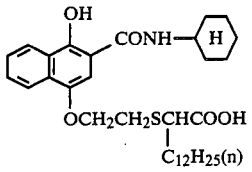

EX-2

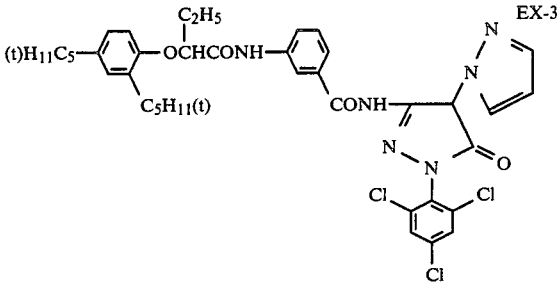

EX-3

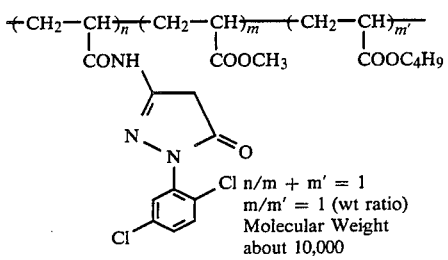

Cl n/m + m' = 1
m/m' = 1 (wt ratio)
Molecular Weight
about 10,000

EX-4

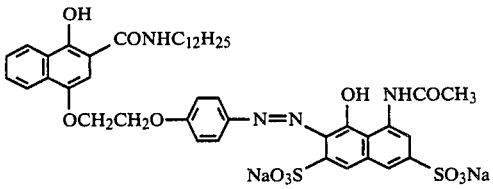

EX-5

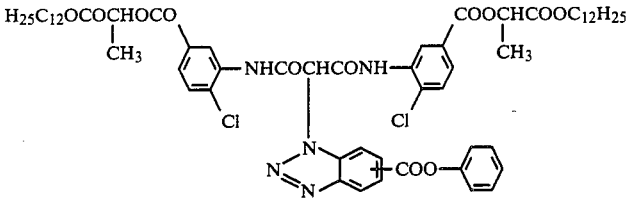

EX-6

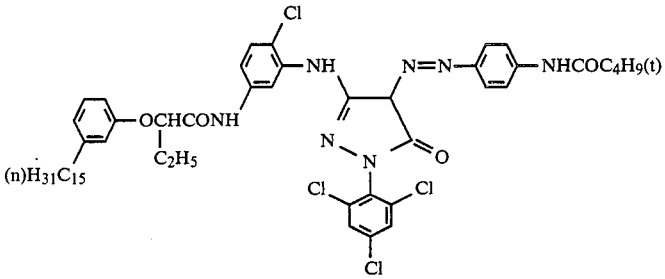

EX-8

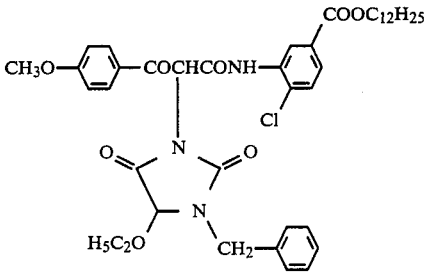

EX-9

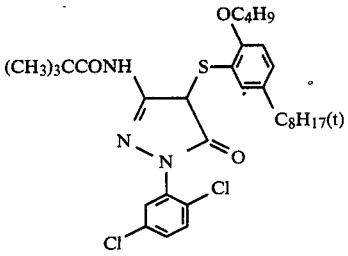

EX-10

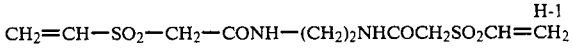

H-1

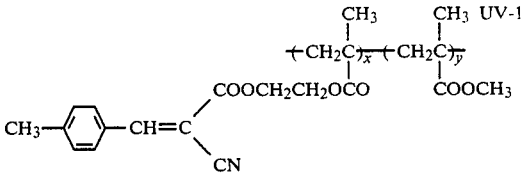

UV-1

The resulting photographic light-sensitive materials were subjected to wedge exposure to light in an exposure amount of 25 CMS using a tungsten light source and a filter to adjust color temperature to 4,800° K., then development processing at 38° C. according to the following processing steps.

| Processing Steps | Time |
|---|---|
| Color Development | 3 min 15 sec |
| Bleaching | shown in Table 1 below |
| Fixing | 3 min 15 sec |
| Washing with Water | 3 min 15 sec |

-continued

| Processing Steps | Time |
|---|---|
| Stabilizing | 30 sec |

The composition of each processing solution used in the above-described processing is as follows.

| | |
|---|---|
| Color Developing Solution | |
| Trisodium Nitrilotriacetate | 1.9 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N—Ethyl-N—β-hydroxyethylamino)-2-methylaniline Sulfate | 4.5 g |
| Water to make | 1.0 liter |
| | pH 10.0 |
| Bleaching Solution | |
| Iron (III) Ammonium Ethylenediaminetetraacetate | 100.0 g |
| Disodium Ethylenediaminetetraacetate | 8.0 g |
| Ammonium Bromide | 150.0 g |
| Compound represented by the general formula (II-a) or (II-b) (shown in Table 1 below) | $5 \times 10^{-3}$ mol |
| Water to make | 1.0 liter |
| | pH 6.0 |
| Fixing Solution | |
| Sodium Tetrapolyphosphate | 2.0 g |
| Sodium Sulfite | 4.0 g |
| Ammonium Thiosulfate Aqueous Solution (70%) | 175.0 ml |
| Sodium Bisulfite | 4.6 g |
| Water to make | 1.0 liter |
| | pH 6.6 |
| Stabilizing Solution | |

-continued

| | |
|---|---|
| Formalin (40%) | 8.0 ml |
| Water to make | 1.0 liter |

To each film sample having been conducted development processed in the above-described manner was measured the minimum density, gradation and sensitivity thereof and further was subjected to X-ray fluorometric analysis to determine the silver amount remaining in the maximum color density portion of the sample.

Moreover, the same photographic light-sensitive materials were exposed to light in the same manner as described above and then subjected to Fujicolor Process CN-16 presented by Fuji Photo Film Co., Ltd. consisting of color development (3 min and 15 sec), bleaching (6 min and 30 sec), washing with water (2 min and 10 sec), fixing (4 min and 20 sec), washing with water (3 min and 15 sec) and stabilizing (1 min and 5 sec) followed by drying and each processing step being carried out at 38.0±0.2° C. The minimum density, gradation and sensitivity of the color images thus-obtained were measured and these values were compared with those obtained by the above-described development processing. The differences are shown in Table 1 below. Each value of the photographic properties except the amount of remaining silver in Table 1 is indicated using the difference of (value obtained by the CN-16 processing)−(value obtained by the above-described development processing). The larger the value is the larger the deviation from the standard processing (CN-16 processing) which means poor results in the photographic properties.

TABLE 1

| Sample No. | Cyan Dye Forming Coupler | Bleach Accelerating Agent | Bleaching Time | Minimum Density B | Minimum Density G | Minimum Density R | Gradation B | Gradation G | Gradation R | Relative Sensitivity B | Relative Sensitivity G | Relative Sensitivity R | Amount of Remaining Silver (μg/cm²) |
|---|---|---|---|---|---|---|---|---|---|---|---|---|---|
| 1 (Comparison) | Comparative Compound A | None | 4 min 20 sec | ±0 | ±0 | ±0 | ±0 | ±0 | ±0 | ±0 | ±0 | ±0 | 3.5 |
| 2 (Comparison) | Comparative Compound A | " | 2 min | " | " | " | x | x | x | x | x | x | 14.2 |
| 3 (Comparison) | C-28 | " | 4 min 20 sec | " | " | " | ±0 | ±0 | ±0 | ±0 | ±0 | ±0 | 3.3 |
| 4 (Comparison) | " | " | 2 min | " | " | " | x | x | x | x | x | x | 13.7 |
| 5 (Comparison) | Comparative Compound A | (II-a)-(1) | 2 min | " | " | " | −0.02 | ±0 | −0.12 | −0.01 | ±0 | −0.08 | 2.6 |
| 6 (Comparison) | Comparative Compound A | " | 2 min 30 sec | " | " | " | " | ±0 | −0.10 | ±0 | ±0 | −0.07 | 2.6 |
| 7 (Comparison) | Comparative Compound A | " | 3 min | " | " | " | " | " | ±0 | " | " | ±0 | 2.0 |
| 8 (Invention) | C-28 | (II-a)-(1) | 2 min | " | " | " | ±0 | ±0 | ±0 | ±0 | ±0 | ±0 | 2.3 |
| 9 (Invention) | C-1 | (II-a)-(2) | " | " | " | " | " | " | " | " | " | " | 3.1 |
| 10 (Invention) | C-6 | (II-a)-(5) | " | " | " | " | " | " | " | " | " | " | 3.6 |
| 11 (Invention) | C-15 | (II-a)-(8) | " | " | " | " | " | " | " | " | " | " | 3.8 |
| 12 (Invention) | C-29 | (II-a)-(1) | " | " | " | " | " | " | " | " | " | " | 2.1 |
| 13 (Invention) | C-31 | " | " | " | " | " | " | " | " | " | " | " | 2.0 |
| 14 (Invention) | C-36 | (II-b)-(1) | " | " | " | " | " | " | " | " | " | " | 3.9 |
| 15 (Invention) | C-40 | (II-b)-(5) | " | " | " | " | " | " | " | " | " | " | 4.0 |
| 16 (Invention) | C-48 | (II-b)-(7) | " | " | " | " | " | " | " | " | " | " | 4.0 |

x: The value could not be determined due to inferior removal of silver.

Comparative Compound A has the following structure:

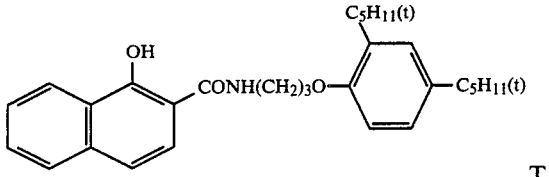

standard sample and substantially the same photographic properties can be obtained.

EXAMPLE 2

The same development processing as described in Example 1 was repeated except that washing with water for 1 min and 5 sec was conducted between bleaching and fixing in the processing steps. The results thus-obtained are shown in Table 2 below.

TABLE 2

| Sample No. | Cyan Dye Forming Coupler | Bleach Accelerating Agent | Bleaching Time | Minimum Density B | Minimum Density G | Minimum Density R | Gradation B | Gradation G | Gradation R | Relative Sensitivity B | Relative Sensitivity G | Relative Sensitivity R | Amount of Remaining Silver (μg/cm²) |
|---|---|---|---|---|---|---|---|---|---|---|---|---|---|
| 17 (Comparison) | Comparative Compound B | None | 4 min 20 sec | ±0 | ±0 | ±0 | ±0 | ±0 | ±0 | ±0 | ±0 | ±0 | 3.5 |
| 18 (Comparison) | Comparative Compound B | " | 2 min | " | " | " | x | x | x | x | x | x | 14.3 |
| 19 (Comparison) | C-28 | " | 4 min 20 sec | " | " | " | ±0 | ±0 | ±0 | ±0 | ±0 | ±0 | 3.3 |
| 20 (Comparison) | " | " | 2 min | " | " | " | x | x | x | x | x | x | 13.7 |
| 21 (Comparison) | Comparative Compound B | (II-a)-(1) | 2 min | " | " | " | ±0 | ±0 | −0.10 | ±0 | ±0 | −0.06 | 2.5 |
| 22 (Comparison) | Comparative Compound B | " | 2 min 30 sec | " | " | " | " | " | −0.08 | " | " | −0.05 | 2.6 |
| 23 (Comparison) | Comparative Compound B | " | 3 min | " | " | " | " | " | ±0 | " | " | ±0 | 2.0 |
| 24 (Invention) | C-28 | (II-a)-(1) | 2 min | " | " | " | " | " | " | " | " | " | 2.3 |
| 25 (Invention) | C-1 | (II-a)-(2) | " | " | " | " | " | " | " | " | " | " | 3.1 |
| 26 (Invention) | C-6 | (II-a)-(5) | " | " | " | " | " | " | " | " | " | " | 3.6 |
| 27 (Invention) | C-15 | (II-a)-(8) | " | " | " | " | " | " | " | " | " | " | 3.7 |
| 28 (Invention) | C-29 | (II-a)-(1) | " | " | " | " | " | " | " | " | " | " | 2.1 |
| 29 (Invention) | C-31 | " | " | " | " | " | " | " | " | " | " | " | 2.0 |
| 30 (Invention) | C-36 | (II-b)-(1) | " | " | " | " | " | " | " | " | " | " | 3.8 |
| 31 (Invention) | C-40 | (II-b)-(5) | " | " | " | " | " | " | " | " | " | " | 4.1 |
| 32 (Invention) | C-48 | (II-b)-(7) | " | " | " | " | " | " | " | " | " | " | 4.0 |

x: The value could not be determined due to inferior removal of silver.

It is apparent from the results shown in Table 1 above that in the samples processed with a bleaching solution which does not contain the bleaching accelerating agent according to the present invention, sufficient removal of silver and good photographic properties are achieved (see Samples 1 and 3). However, it is recognized that in cases where the shorter bleaching time is employed, removal of silver is incomplete and the photographic properties are adversely affected (see Samples 2 and 4).

Further, in the samples using a cyan dye forming coupler other than the cyan dye forming couplers according to the present invention and processed with the bleaching solution containing the bleach accelerating agent according to the present invention, the silver removing property and photographic properties equal to those obtained in the standard sample processed with the CN-16 processing are obtained and thus good photographic properties can be achieved by the longer bleaching tire (see Sample 7). However, in cases wherein the bleaching time is shortened, large decreases in the gradation and sensitivity of R in comparison with the standard sample are particularly observed while the silver removing property is not adversely affected. These results demonstrate the degradation of the photographic properties (see Samples 5 and 6).

On the other hand, in Samples 8 to 16 using the cyan dye forming couplers according to the present invention and processed with the bleaching solution containing the bleach accelerating agents according to the present invention, good photographic images having better a silver removing property compared with the Comparative Compound B employed as a cyan dye forming coupler has the following structure:

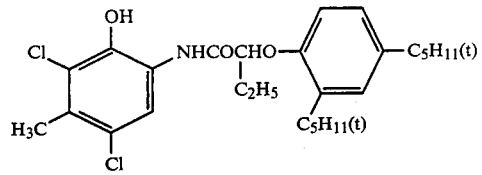

It is understood from the results shown in Table 2 above that in the samples using the cyan dye forming couplers according to the present invention and processed with the bleaching solution containing the bleach accelerating agents according to the present invention, good photographic images having better desilvering property compared with the standard sample processed with the CN-16 processing and substantially the same photographic properties can be obtained in by the processing method in which a washing with water step is conducted between the bleaching step and the fixing step, even when the bleaching processing is practiced in a short period.

EXAMPLE 3

Samples 33 to 41 were prepared in the same manner as described in Example 1 except that the couplers as shown in Table 1 were used in an amount of 0.02 mol per mol of silver in place of Coupler EX-2 employed in the high speed red-sensitive emulsion layer (Fourth Layer), respectively.

These samples were subjected to exposure to light and development processing in the same manner as described in Example 1 wherein the bleach accelerating agents as shown in Table 1 were employed in the bleaching solution, respectively.

The samples thus-processed exhibited good desilvering property and photographic properties which were substantially equal to those obtained in Samples 8 to 16 in Example 1.

EXAMPLE 4

On a triacetylcellulose film support were coated the same layers (First layer to twelfth layer) as Example 1 to prepare a multilayer color photographic light-sensitive material except that the couplers as shown in Table 4 were used in the third layer instead of the couplers shown in Table 1 used in the third layer of Example 1, and the couplers as shown in Table 4 were used in the forth layer instead of coupler EX-2 used in the forth layer of Example 1.

The photographic sensitive materials prepared were cut into strips having a width of 3.5 cm. After being subjected to image exposure, these strips were separately subjected to continuous development processing. The forward and rearward edges of these strips were subjected to wedge exposure to light in an exposure amount of 25 CMS using a tungsten light source and a filter to adjust the color temperature to 4800° K. This treatment was used to evaluate the photographic properties and desilvering, property.

| Processing Steps | Temp. | Time |
|---|---|---|
| Color Development | 38° C. | 3 min. |
| Bleaching | " | 4 min. and 20 sec. |
| Fixing | " | 3 min. |
| Washing with water | " | 3 min. |
| Stabilizing | " | 1 min. |

The above treatments each started using 500 ml of the mother liquor of the respective treating solution of the composition shown hereinafter. Afterward, every 1 m of the photographic sensitive materials were treated, the treating solutions were supplied at the rates shown in Table 3. Thus, 40 m of these strips were continuously treated.

(Evaluation of the photographic properties and desilvering property)

The forward and rearward edges of these strips thus treated were measured for the minimum density, gradation and sensitibity of the dye image thus wedge exposured. The forward edge was treated with a fresh solution, and the rearward edge was treated with a used solution which had continuously treated the photographic sensitive material. The difference between both edges in these values are shown in Table 4.

Furthermore, these were subjected to X-ray fluorometric analysis to determine the silver amount remaining in the maximum density portion of the sample in the treatment with used solution. The results of the measurement are shown in Table 4.

TABLE 3

| Processing Steps | Make-up amount per 1 $m^2$ strip (3.5 cm width) of each photosensitive material |
|---|---|
| Color Development | 38 ml |
| Bleaching | 20 ml |
| Fixing | 31 ml |
| Washing with water | Wash with a plenty of water |
| Stabilizing | 31 ml |

| | Tank solution | Make-up |
|---|---|---|
| Color developing solution | | |
| Trisodium nitrilotriacetate | 1.0 g | 1.1 g |
| Sodium sulfite | 4.0 g | 4.4 g |
| Sodium carbonate | 30.0 g | 32.0 g |
| Potassium bromide | 1.4 g | 0.7 g |
| Hydroxylamine sulfate | 2.4 g | 2.6 g |
| 4-(N—ethyl-N—o-hydroxy-ethylamino)-2-methylaniline sulfate | 4.5 g | 5.0 g |
| Water to make | 1 l | 1 l |

| | Mother liquor | Make-up |
|---|---|---|
| Bleaching solution | | |
| Ammonium bromide | 160.0 g | 176 g |
| Ammonia water (28%) | 25.0 g | 15 ml |
| Iron sodium ethylene-diaminetetraacetate | 130.0 g | 143 g |
| Glacial acetic acid | 14.0 ml | 14.0 ml |
| Compound of the general formula (II-a) or (II-b) of the present invention (shown in Table 4) | $5 \times 10^{-3}$ mol | $6 \times 10^{-3}$ mol |
| Water to make | 1 l | 1 l |
| Fixing solution | | |
| Sodium tetrapolyphosphate | 2.0 g | 2.2 g |
| Sodium sulfite | 4.0 g | 4.4 g |
| Ammonium thiosulfate aqueous solution (70%) | 175.0 ml | 193.0 ml |
| Sodium bisulfite | 4.6 g | 5.1 g |
| Water to make | 1 l | 1 l |
| Stabilizing solution | | |
| Formalin | 8.0 ml | 9.0 ml |
| Water to make | 1 l | 1 l |

TABLE 4

| | Sample No. | Cyan Dye Forming Coupler | Bleach Accelerating Agent | Bleaching Time | Minimum Density B | Minimum Density G | Minimum Density R | Gradation B | Gradation G | Gradation R | Relative Sensitivity B | Relative Sensitivity G | Relative Sensitivity R | Amount of Remaining Silver ($\mu g/cm^2$) |
|---|---|---|---|---|---|---|---|---|---|---|---|---|---|---|
| Comparison | 33 | Comparative Compound A | (II-a)-1 | 4 min. 20 sec. | ±0 | ±0 | ±0 | −0.02 | ±0 | −0.13 | ±0 | ±0 | −0.07 | 2.6 |
| " | 34 | Comparative Compound A | " | " | " | " | " | −0.01 | " | −0.15 | " | " | −0.08 | 2.6 |
| Invention | 35 | C-28 | " | " | " | " | " | ±0 | ±0 | ±0 | ±0 | ±0 | ±0 | 2.4 |
| " | 36 | C-1 | " | " | " | " | " | " | " | " | " | " | " | " |
| " | 37 | C-6 | " | " | " | " | " | " | " | " | " | " | " | " |
| " | 38 | C-15 | " | " | " | " | " | " | " | " | " | " | " | " |
| " | 39 | C-29 | " | " | " | " | " | " | " | " | " | " | " | " |
| " | 40 | C-31 | " | " | " | " | " | " | " | " | " | " | " | " |

TABLE 4-continued

| | Sample No. | Cyan Dye Forming Coupler | Bleach Accelerating Agent | Bleaching Time | Minimum Density B | Minimum Density G | Minimum Density R | Gradation B | Gradation G | Gradation R | Relative Sensitivity B | Relative Sensitivity G | Relative Sensitivity R | Amount of Remaining Silver ($\mu g/cm^2$) |
|---|---|---|---|---|---|---|---|---|---|---|---|---|---|---|
| " | 41 | C-36 | " | " | " | " | " | " | " | " | " | " | " | " |
| " | 42 | C-40 | " | " | " | " | " | " | " | " | " | " | " | " |
| " | 43 | C-48 | " | " | " | " | " | " | " | " | " | " | " | " |
| Comparison | 44 | Comparison A | (II-a)-5 | " | " | " | " | −0.01 | ±0 | −0.14 | " | " | −0.07 | 3.2 |
| " | 45 | Comparison A | (II-a)-8 | " | " | " | " | −0.02 | " | −0.14 | " | " | −0.07 | 3.2 |
| " | 46 | Comparison A | (II-b)-1 | " | " | " | " | −0.01 | " | −0.13 | " | " | −0.07 | 3.0 |
| Invention | 47 | C-28 | (II-a)-5 | " | " | " | " | ±0 | ±0 | ±0 | ±0 | ±0 | ±0 | 3.0 |
| " | 48 | " | (II-a)-8 | " | " | " | " | " | " | " | " | " | " | 3.0 |
| " | 49 | " | (II-b)-1 | " | " | " | " | " | " | " | " | " | " | 2.8 |
| Comparison | 50 | Comparison A | None | 4 min. 20 sec. | " | " | " | " | " | " | " | " | " | 4.0 |
| " | 51 | C-28 | " | 4 min. 20 sec. | " | " | " | " | " | " | " | " | " | 3.8 |

As can be seen in Table 4, if the continuous treatment of a photographic sensitive material is effected using a bleaching agent containing the compound represented by the general formula (II-a) or (II-b) of the present invention, the cyan dye forming couplers other than that of the present invetnion (Sample 33, 34, 44, 45, 46) soften and worsen the gradation of a cyan image. On the other hand, the cyan dye forming coupler represented by the general formula (I-a) or (I-b) of the present invention does not worsen the photographic properties and is excellent in performing desilvering. (Sample 35 to 43, 47 to 49). It can also be seen that if the continuous treatment of a photographic sensitive material is effected using a bleaching agent free of a bleaching promoter represented by the general formula (II-a) or (II-b), even the cyan dye forming couplers other than that of the present invention does not degradate the photographic properties (Sample 50). Tha is, if the continuous treatment of a photogrpahic sensitive material is effected using a bleaching agent containing the compound represented by the general formula (II-a) or (II-b), the photographic properties are degradated unless the cyan dye forming couplers represented by the general formula (I-a) or (I-b) of the present invention are used.

While the invention has been described in detail and with reference to specific embodiment thereof, it will be apparent to one skilled in the art that various changes and modifications can be made therein without departing from the spirit and scope thereof.

What is claimed is:

1. A method for processing a color photographic light-sensitive material comprising subjecting an imagewise exposed silver halide color photographic light-sensitive material to color development processing, then to processing with a bleaching solution and thereafter to separately fixing processing, wherein the silver halide color photographic light-sensitive material contains a cyan dye forming coupler represented by general formula (I-a) and the bleaching solution contains a compound represented by general formula (II-a):

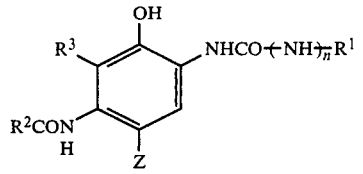

(I-a)

wherein $R^1$ and $R^2$ each represents a substituted or unsubstituted aliphatic group, a substituted or unsubstituted aryl group or a substituted or unsubstituted heterocyclic group; $R^3$ represents a hydrogen atom; a halogen atom, a substituted or unsubstituted aliphatic group, a substituted or unsubstituted aryl group or an acylamino group, or $R^3$ represents a nonmetallic atomic group necessary to form a nitrogen-containing 5-membered or 6-membered ring together with $R^2$; $Z^1$ represents a hydrogen atom or a group capable of being released upon the oxidative coupling reaction with a developing agent; and n represents 0 or 1,

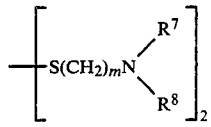

(II-a)

wherein $R^7$ and $R^8$, which may be the same or different, each represents a hydrogen atom, a substituted or unsubstituted lower alkyl group or an acyl group, or $R^7$ and $R^8$ connect to each other to form a ring; and m represents an integer of 1 to 3.

2. A method for processing a color photographic light-sensitive material as claimed in claim 1, wherein the aliphatic group represented by $R^1$ or $R^2$ is an aliphatic group having from 1 to 32 carbon atoms.

3. A method for processing a color photographic light-sensitive material as claimed in claim 1, wherein the substituent for the aliphatic group, the aryl group or the heterocyclic group represented by $R^1$ $R^2$ is selected from an alkyl group, an aryl group, a heterocyclic group, an alkoxy group, an aryloxy group, an alkenyloxy group, an acyl group, an ester group, an amido group, a sulfamido group, an imido group, an ureido group, an aliphatic or aromatic thio group, an aliphatic or aromatic sulfonyl group, a hydroxy group, a cyano group, a carboxy group, a nitro group, a sulfo group and a halogen atom.

4. A method for processing a color photographic light-sensitive material as claimed in claim 1, wherein $Z^1$ represents a hydrogen atom, a halogen atom, an alkoxy group, an aryloxy group, an acyloxy group, a sulfonyloxy group, an amido group, an alkoxycarbonyloxy group, an aryloxycarbonyloxy group, an aliphatic or aromatic thio group, an imido group or an aromatic azo group.

5. A method for processing a color photographic light-sensitive material as claimed in claim 1, wherein $R^1$ is an aryl group substituted with one or more substituents selected from a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group and a cyano group.

6. A method for processing a color photographic light-sensitive material as claimed in claim 1, wherein $R^2$ is an alkyl group substituted with a substituted aryloxy group.

7. A method for processing a color photographic light-sensitive material as claimed in claim 1, wherein $Z^1$ represents a hydrogen atom, a halogen atom, an alkoxy group, an aryloxy group, an acyloxy group or a sulfonamido group.

8. A method for processing a color photographic light-sensitive material as claimed in claim 1, wherein $R^7$ and $R^8$ each represents a lower alkyl group or an acyl group having from 1 to 3 carbon atoms.

9. A method for processing a color photographic light-sensitive material as claimed in claim 1, wherein the silver halide emulsion layer is a red-sensitive silver halide emulsion layer.

10. A method for processing a color photographic light-sensitive material as claimed in claim 1, wherein the amount of the compound represented by the general formula (II-a) in the bleaching solution is from $1\times10^{-5}$ to $1\times10^{-1}$ mol per liter of the bleaching solution.

11. A method for processing a color photographic light-sensitive material as claimed in claim 1, wherein the bleaching solution further contains a bleaching agent comprising a ferric ion complex salt.

12. A method for processing a color photographic light-sensitive material as claimed in claim 11, wherein the ferric ion complex salt is a complex of ferric ion and a chelating agent which is selected from an aminopolycarboxylic acid, an aminopolyphosphonic acid and a salt thereof.

13. A method for processing a color photographic light-sensitive material as claimed in claim 11, wherein the amount of the bleaching agent is from 0.1 to 2 mols per liter of the bleaching solution.

14. A method for processing a color photographic light-sensitive material as claimed in claim 1, wherein the pH of the bleaching solution is from 3.0 to 8.0.

15. A method for processing a color photographic light-sensitive material as claimed in claim 1, wherein the bleaching solution further contains a compound which is selected from a compound represented by the following general formula (III-a) or (III-b):

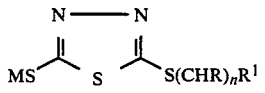
(III-a)

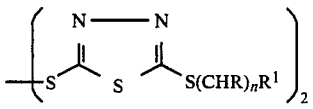
(III-b)

wherein M represents a hydrogen atom, an alkali metal atom or an ammonium ion; R represents a hydrogen atom, a substituted or unsubstituted alkyl group; $-SO_3M^1$ or $-COOM^1$; $R^1$ represents $-SO_3M^1$ or $-COOM^1$; $M^1$ represents represents a hydrogen atom, an alkali metal atom or an ammonium ion; and n represents an integer from 1 to 6 and when n is 2 or more, each R may be the same or different.

16. A method for processing a color photographic light-sensitive material as claimed in claim 1, wherein the processing time for the bleaching solution is not more 6 minutes and 30 seconds.

17. A method for processing a color photographic light-sensitive material as claimed in claim 1, wherein the processing time for the bleaching solution is not more than 3 minutes and 30 seconds.

18. A method for processing a color photographic light-sensitive material as claimed in claim 1, wherein the processing time for the bleaching solution is not more than 2 minutes and 30 seconds.

19. A method for processing a color photographic light-sensitive material as claimed in claim 1, wherein the processing time for the bleaching solution is from 30 seconds to 2 minutes and 30 seconds.

20. A method for processing a color photographic light-sensitive material as claimed in claim 1, wherein the color photographic light-sensitive material is a coupler-containing multilayer color negative light-sensitive material for photographing.

21. A method for processing a color photographic light-sensitive material as claimed in claim 1, wherein the color photographic light-sensitive material is a coupler-containing multilayer color reversal light-sensitive material for photographing.

22. A method for processing a color photographic light-sensitive material as claimed in claim 1, wherein the amount of the compound represented by general formula (I-a) employed in the silver halide emulsion layer is in a range of $2\times10^{-3}$ to $5\times10^{-1}$ mole per mole of silver.

23. A method for processing a color photographic light-sensitive material claimed in claim 1, wherein the processing with a bleaching solution is conducted by a continuous bleaching process.

24. A method for processing a color photographic light-sensitive material as claimed in claim 1, wherein $R^1$ is an aryl group substituted with one or more substituents selected from a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group and a cyano group, $R^2$ is selected from the group consisting of a substituted or unsubstituted alkyl group or a substituted or unsubstituted aryl group, and $R^3$ is a hydrogen atom, wherein $Z^1$ is a halogen atom.

* * * * *

UNITED STATES PATENT AND TRADEMARK OFFICE

CERTIFICATE OF CORRECTION

PATENT NO. : 4,621,047

DATED : November 4, 1986

INVENTOR(S) : Shinzo Kishimoto et al

It is certified that error appears in the above-identified patent and that said Letters Patent is hereby corrected as shown below:

Title page:

Insert the following:

--[30] Foreign Application Priority Data

May 21, 1984 [JP] Japan . . . . . 102354/84

June 26, 1984 [JP] Japan . . . . . 131506/84--

Signed and Sealed this

Tenth Day of March, 1987

*Attest:*

DONALD J. QUIGG

*Attesting Officer*

*Commissioner of Patents and Trademarks*